US005291097A

United States Patent [19]

Kawamura et al.

[11] Patent Number: 5,291,097

[45] Date of Patent: Mar. 1, 1994

[54] CATHODE-RAY TUBE

[75] Inventors: Hiromitsu Kawamura; Katsumi Kobara, both of Mobara; Takao Kawamura, Chiba; Kiyoshi Miura, Mobara, all of Japan

[73] Assignee: Hitachi, Ltd., Tokyo, Japan

[21] Appl. No.: 694,367

[22] Filed: May 1, 1991

[30] Foreign Application Priority Data

May 14, 1990 [JP] Japan ..... 2-121115
May 25, 1990 [JP] Japan ..... 2-133806
Aug. 13, 1990 [JP] Japan ..... 2-211720

[51] Int. Cl.[5] ..... H01J 31/08

[52] U.S. Cl. ..... 313/478; 313/479; 427/126.3; 348/820; 348/834

[58] Field of Search ..... 313/478, 479; 358/252; 427/106, 427, 126.3

[56] References Cited

U.S. PATENT DOCUMENTS 3,940,511 2/1976 Deal et al. ..... 313/479 X
4,945,282 7/1990 Kawamura et al. ..... 313/479

FOREIGN PATENT DOCUMENTS 2234237 6/1974 France .
2629268 12/1988 France .
0096638 6/1984 Japan .
61-118946 6/1986 Japan .

OTHER PUBLICATIONS

IBM Technical Disclosure Bulletin vol. 27, No 5, Oct. 1984.

*Primary Examiner*—Donald J. Yusko
*Assistant Examiner*—Nimesh Patel
*Attorney, Agent, or Firm*—Antonelli, Terry Stout & Kraus

[57] ABSTRACT

A cathode-ray tube having a layer provided on a face plate outer surface, with the layer comprising at least one colored transparent electroconductive domain consisting of at least one organic dye, at least one electroconductive metal oxide and silica mainly composed of silica gel and at least one non-glare and protective domain consisting of silica mainly composed of silica gel, thereby resulting an a cathode-ray tube having wide and stable optical properties, high contrast, and antistatic property to remove the panel electricity generated by static induction, and an antireflection property.

9 Claims, 2 Drawing Sheets

CATHODE-RAY TUBE

FIELD OF THE INVENTION

The present invention relates to a cathode-ray tube having wide and stable optical properties, high contrast, an antistatic property to effectively remove the electricity generated on the panel by static induction, and high mechanical and chemical durabilities, as well as to a process for producing the same.

BACKGROUND OF THE INVENTION

To allow a cathode-ray tube to have an ability to swiftly transfer the electricity generated by the static induction caused by the a turning on or off of a switch, to ground, i.e. an antistatic property and to provide high image contrast, has been proposed a method to form a colored transparent electroconductive film on the face plate of a cathode-ray tube in Japanese Patent Application No. 1-145325. That is, it has been proposed to coat a colored transparent electroconductive film, on an outer surface of the face plate of cathode-ray tube, by an alcohol solution containing one or more organic dyes, at least one electroconductive metal oxide selected from tin oxide ($SnO_2$), indium oxide ($In_2O_3$), and antimony oxide ($Sb_2O_3$), and ethyl silicate, and to heat and dry the surface at a temperature of about 100°-200° C.

In the above proposed method, the alcohol solution firstly prepared by firstly preparing a solution consisting of at least one metal oxide selected from $SnO_2$, $In_2O_3$ and $Sb_2O_3$, ethyl silicate capable of forming a silica gel when subjected to hydrolysis and then to dehydration-condensation, a mixed solution consisting of alcohols, ketones or the like, water and an acid catalyst, and then adding thereto at least one organic dye capable of providing desired optical properties, selected from azo dyes, anthraquinone dyes and the like, with the coating of the alcohol solution being carried out by any of spin coating, dip coating and spray coating.

The above proposed method has a number of problems, namely, the colored transparent electroconductive film may exhibit desired light absorption when it contains one or more organic dye in an amount as small as 1% by weight or less, and may give high image contrast; however, the film tends to show earlier color fading when exposed to water, an acid, an alkali, an organic solvent or, the like. The film shows color fading in about one hour particularly at high temperatures, for example, when placed in a boiling water. Since it is anticipated that electric appliances using the film may be subjected to high temperatures and high humidity during the storage, marine transportation, etc., it has been required to improve the water resistance and chemical resistance of the film.

Another problem resides in the fact that when a solution for formation of a colored transparent electroconductive film is coated on the face plate and subsequently or simultaneously therewith a solution for formation of a non-glare surface protective layer composed mainly of an alcohol solution containing ethyl silicate is coated on the surface-coated face plate, the color dye or other components in the colored transparent electro-conductive film dissolves in and spreads into the non-glare surface protective layer because the surface of the film is unstable and active.

Since the solution for formation of a non-glare surface protective layer contains large amounts of an alcohol, water, etc. and has a low viscosity, the solution tends to dissolve the dye, etc. present in the colored transparent electroconductive film. When there is such dissolution, the dye is removed when the surface of cathode-ray tube is cleaned with a solvent, thereby resulting in a deterioration in the optical properties of the cathode-ray tube.

Furthermore, the conventionally used organic dyes used are not sufficient in chemical and optical durabilities and need improvement.

SUMMARY OF THE INVENTION

An object of the present invention is to solve the above-mentioned problems of the prior art and to provide a cathode-ray tube having wide and stable optical properties, high contrast, an ability to effectively remove the electricity generated on the face plate by static induction, and high mechanical and chemical durabilities, as well as to provide a process for producing such a cathode-ray tube.

Another object of the present invention is to solve the problems of the prior art and to provide a cathode-ray tube capable of selectively absorbing two intermediate colors thereby giving improved contrast, high color purity and clearer colors, as well as to provide a process for producing such a cathode-ray tube.

According to the present invention, a cathode ray tube is provided having, on at least one portion of the face plate outer surface, a layer. The layer includes at least one colored transparent electroconductive domain consisting of at least one organic dye, at least one electroconductive metal oxide selected from the group consisting of tin oxide, indium oxide and antimony oxide, and silica mainly composed of silica gel, with at least one non-glare protective domain consisting of silica mainly composed of silica gel.

A process for producing a cathode-ray tube of the present invention comprises the steps of coating at least one portion of the face plate outer surface of a cathode-ray tube with an alcohol solution containing at least one organic dye, at least one electroconductive metal oxide selected from the group consisting of tin oxide, indium oxide and antimony oxide, an alkyl silicate, water and an acid catalyst; coating an alcohol solution containing an alkyl silicate on the surface of the surface-coated face plate obtained in the first step; and heat drying the undried multi-layered face plate obtained in the second coating step.

In accordance with further feature of the present invention, a process for producing a cathode-ray tube is provided which comprises the steps of coating at least one portion the face plate outer surface of a cathode-ray tube with an alcohol solution containing at least one organic dye, at least one electroconductive metal oxide selected from the group consisting of tin oxide, indium oxide, and antimony oxide, an alkyl silicate, water and an acid catalyst; applying steam to the surface of the surface-coated face plate obtained in the coating step; coating an alcohol solution containing an alkyl silicate on the surface of the surface-coated and steam-applied face plate; and heat drying the undried multi-layered face plate obtained in the second coating step.

DETAILED DESCRIPTION OF THE INVENTION

Figure 1:
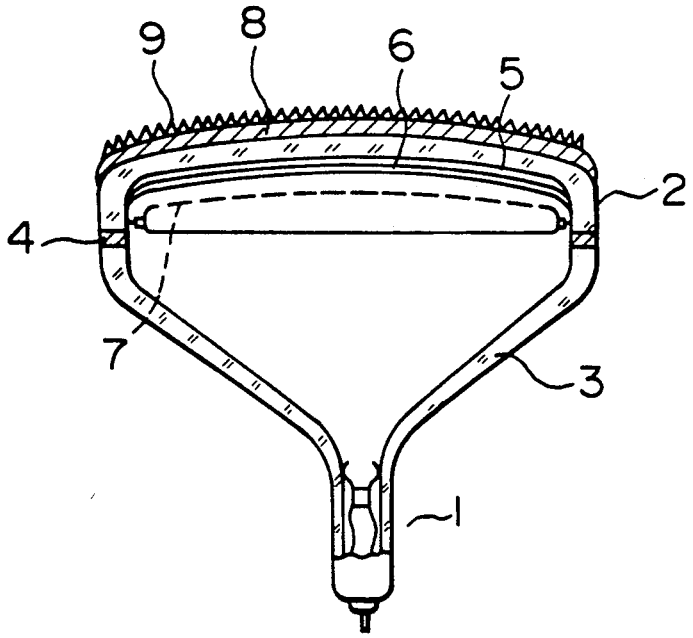
FIG. 1 is a partially broken front view showing the rough constitution of an embodiment of the cathode-ray tube of the present invention.

The cathode-ray tube of the present invention has, on at least one portion of the face plate outer surface, a layer comprising at least one colored transparent electroconductive (CTE) domain (hereinafter CTE domain) and at least one non-glare and protective (NGP) domain.

The CTE domain consists of at least one organic dye, at least one electroconductive metal oxide selected from the group consisting of tin oxide, indium oxide and antimony oxide, and silica mainly composed of silica gel. The CTE domain may have a film form, a disc form or ring form.

The type of organic dye is not particularly restricted. It is preferably selected from acid dyes, cationic dyes, reactive dyes, direct dyes and disperse dyes, which dyes have a high lightfastness and chemical resistance. Specific examples of such a dye include sodium fluorescein, Rhodamine, oil blue, oil violet, Acid Rhodamine B, Alizarine Direct Blue AGG, Acid Light Yellow 2G, Acid Red 3bl, Sirius Supra Orange GGL and React Yellow E-SNA. They can be used alone or in combination of two or more.

In order to impart improved contrast, it is effective to select from the above organic dyes a combination of different dyes capable of selectively and simultaneously absorbing light having a wavelength of 560–600 nm and light having wavelengths of 480–500 nm, both emitted from the fluorescent substances coated on the face plate inner surface and then use combination of different dyes in a solution for formation of CTE domain described later.

The different dyes used in combination may be present on the face plate outer surface of cathode-ray tube in the form of two or more layers, with each layer being a film-like CTE domain containing a particular organic dye having particular absorption characteristic, or alternatively in the form of one film-like CTE domain containing at least two different organic dyes having different absorption characteristics, or alternatively in the form of two layers, one layer being a film-like CTE domain containing one organic dye and the other layer being a film-like CTE domain containing two or more other organic dyes.

By allowing the film-like CTE domain to have selective light absorption characteristics for wavelength range of 480–500 nm and 560–600 nm, a color tone of longer wavelength side is more deepened with the conventional technique thereby a vivid picture can be obtained, and a blue-green color is extinguished by light of wavelengths of 560–600 nm whereby a blue color and a green color can be produced distinctly.

The use of the above-mentioned organic dyes further makes it possible to obtain a cathode-ray tube having sharp absorption characteristics, an excellent lightfastness and chemical stability.

The amount of the organic dye or dyes used in the CTE domain has no particular restriction. It is generally 1% by weight or less based on the amount of the solution for formation of CTE domain described later.

The metal oxide used in the CTE domain is at least one electroconductive metal oxide selected from the group consisting of tin oxide, indium oxide and antimony oxide.

The shape and size of the metal oxide have no particular restriction. However, the metal oxide generally has diameters not larger than the wavelength of visible light, preferably, not larger than 100 nm, more preferably, not larger than 50 nm, most preferably, not larger than 10 nm.

The amount of the metal oxide used in the CTE domain has no particular restriction. However, the metal oxide is generally used in such an amount as the resulting cathode-ray tube has a resistance of $10^5$–$10^{11}$ $\Omega/cm^2$.

The form of the silica mainly composed of silica gel used in the CTE domain has no particular restriction. However, it is preferably in the form of fine particles, a uniform layer or their mixture.

The cathode-ray tube of the present invention can be produced by two processes, with the first process for producing a cathode-ray tube comprising the steps of coating at least one portion of the face plate outer surface of a cathode-ray tube with an alcohol solution containing at least one organic dye, at least one electroconductive metal oxide selected from the group consisting of tin oxide, indium oxide, and antimony oxide, an alkyl silicate, water and acid catalyst; spray-coating, spin-coating or dip-coating an alcohol solution containing an alkyl silicate on the surface of the surface-coated face plate obtained in the coating step; and heat-drying the undried multi-layered face plate obtained in the spray coating step.

The second process for producing a cathode-ray tube of the present invention comprises the steps of coating at least one portion of the face plate outer surface of the cathode-ray tube with an alcohol solution containing at least one organic dye, at least one electroconductive metal oxide selected from the group consisting of tin oxide, indium oxide, and antimony oxide, alkyl silicate, water and an acid catalyst; applying steam to a surface of the surface-coated face plate obtained in the coating step; spray-coating or dip-coating an alcohol solution containing an alkyl silicate on the surface of the surface-coated and steam-applied face plate obtained in the steam applying step; and drying the undried multi-layer face obtained in the spray-coating step.

In the first process, the solution used for formation of CTE domain is an alcohol solution containing at least one organic dye, at least one electro-conductive metal oxide selected from the group consisting of tin oxide, indium oxide and antimony oxide, an alkyl silicate, water and an acid catalyst.

The types of the organic dyes and the metal oxides have been described as above.

Specific examples of the alkyl silicate are methyl silicate, ethyl silicate, n-propyl silicate, isopropyl silicate, n-butyl silicate, isobutyl silicate, sec-butyl silicate and tert-butyl silicate. Of these, methyl silicate and ethyl silicate are preferable, and ethyl silicate is more preferable.

The acid catalyst may be any acid as long as it can generate hydronium ion when dissolved in water. Specific examples of the acid catalyst are hydrochloric acid, nitric acid, acetic acid and sulfuric acid.

The alcohol may be any alcohol as long as it is compatible with water. Specific examples of the alcohol are methanol, ethanol, propanol, isopropanol, tert-butyl alcohol, allyl alcohol, ethylene glycol and glycerol.

The solution for formation of CTE domain can further comprise a small amounts of ketones, etc.

The amount of the organic dyes used in the solution for formation of CTE domain has no particular restriction but is generally not more than 1% by weight.

The amount of the metal oxides used in the solution for formation of CTE domain has no particular restriction but is generally used so that the resulting cathode-ray tube has a resistance of $10^2$–$10^{11}$ $\Omega/cm^2$.

The solution for formation of CTE domain can be obtained by mixing the above components and stirring them so as to give a uniform solution.

The method for coating the solution for CTE domain formation on the face plate of a cathode-ray tube is not particularly restricted, but there is generally used spray coating, dip coating or spin coating. The dip coating or spin coating forms a film-like CTE domain, and spray coating forms disc-like or ring-like CTE domains overlapping with each other. Some of the disc-like or ring-like CTE domains have a diameter of 10 $\mu$ or less. The others have a diameter of about 20 $\mu$ or 50 $\mu$ or more. This coating gives a surface-coated face plate comprising a face plate and the solution for CTE domain formation coated thereon.

The solution used for formation of NGP domain is an alcohol solution containing an alkyl silicate, water and an acid catalyst.

The types of the alkyl silicate, the alcohol and the acid catalyst have been described as above.

The amount of the alcohol used in the solution for NGP domain formation is not particularly restricted, but is generally 40–95% by weight. The composition of the alcohol is not particularly restricted, but preferably consists of 39–85% by weight of ethanol and 1–10% by weight of isopropanol. The amount of the acid catalyst and water in the solution for NGP domain formation is not particularly restricted, but is generally 2–50% by weight.

The amount of the alkyl silicate in the solution for NGP domain formation is not particularly restricted, but is 0.3–5.0% by weight in terms of silica generated by decomposition.

The solution for formation of NGP domain can be obtained by mixing the above components and stirring them so as to give a uniform solution.

The method for coating the solution for NGP domain formation on the surface of the surface-coated face plate comprising a face plate and the solution for CTE domain formation coated thereon is not particularly restricted, but there is generally used spray coating, dip coating or spin coating. Preferably, the solution for NGP domain formation is coated so as to cover the entire part of the solution for CTE domain formation coated on the face plate. The dip coating or spin coating forms a film-like NGP domain, and spray coating forms disc-like or ring-like NGP domains overlapping with each other. This coating gives an undried multi-layered face plate comprising a face plate, the solution for CTE domain formation coated thereon and the solution for NGP domain formation coated further thereon.

The conditions for heat-drying the undried multi-layered face plate comprising a face plate, the solution for CTE domain formation coated thereon and the solution for NGP domain formation coated further thereon are not particularly restricted, but are preferably at 80°–250° C. for 5–120 minutes.

Thus, there can be obtained a cathode-ray tube of the present invention.

The CTE domains formed as above comprise organic dyes and a stable reaction product from an alkyl silicate and accordingly can produce colors of wide range by simply selecting organic dyes having desired optical characteristics and appropriately determining their amounts. The CTE domains further comprise at least one electroconductive metal oxide selected from $SnO_2$, $In_2O_3$ and $Sb_2O_3$ and, accordingly, can have stable and sufficient antistatic property.

In the cathode-ray tube of the present invention, the CTE domains are covered by silica mainly composed of silica gel and accordingly has significantly improved chemical and mechanical durabilities. Further, the silica, having a refractive index (about 1.4) smaller than those of $SnO_2$, $In_2O_3$and $Sb_2O_3$ used as an electroconductive substance, has a non-glare action and can be an aid in effective control of optical properties. That is, the CTE domains themselves, which have a refractive index of 1.50–1.52, are unable to reduce the refractive index of the face plate (1.52) and gives a glossy impression; however, the use of silica so as to cover the CTE domain can reduce the refractive index of the face plate.

In the second process, the solution used for formation of CTE domain is an alcohol solution containing at least one organic dye, at least one electroconductive metal oxide selected from the group consisting of tin oxide, indium oxide and antimony oxide, an alkyl silicate, water and an acid catalyst.

The types and amounts of the components used in the solution for CTE domain formation have been described as above.

The solution for CTE domain formation can be obtained by mixing the above components and stirring them so as to give a uniform solution.

The method for coating the solution for CTE domain formation is not particularly restricted, but there is generally used spray coating, dip coating or spin coating. This coating gives a surface-coated face plate comprising a face plate and the solution for CTE domain formation coated thereon.

Then, steam is applied to the surface-coated face plate.

The temperature of the steam is not lower than 30° C., generally 30°–100° C.

The reason why steam is applied to the surface of the surface-coated face plate after the solution for CTE domain formation has been coated on the face plate outer surface is to promote the following hydrolysis reaction of alkyl silicate and subsequent dehydration-condensation reaction to form a strong silica ($SiO_2$) film.

$$Si(OR)_4 + 4H_2O \rightarrow Si(OH)_4 + 4ROH \quad (1)$$

$$2Si(OH)_4 \rightarrow 2SiO_2 + 4H_2O \quad (2)$$

wherein R is an alkyl.

Immediately after the solution for CTE domain formation has been coated on the face plate outer surface, the above reactions are incomplete on the surface of the coated solution. Meanwhile, the solution for NGP domain formation to be coated next has a low viscosity. Therefore, if the solution for NGP domain formation comes in contact with the solution for CTE domain formation which has not sufficiently completed the above reactions, dissolution of the color dyes, etc. present in the solution for CTE domain formation into the solution for NGP domain formation is brought about. However, coating of the solution for NGP domain formation after promotion of the above hydrolysis reaction, subsequent dehydration-condensation reaction and resultant formation of stable $SiO_2$ film can prevent oozing-out of color dyes, etc. and makes it possible to obtain a combination of CTE domains and NGP domains which has high mechanical and chemical strengths and which is stable optically.

In this connection, the reason why the temperature of steam applied to the coated solution for CTE domain formation is preferably 30°-100° C. is that 30° C. is the lowest temperature at which the above reactions can be controlled throughout the year and that at temperatures higher than 100° C. the fluidity of the solution for NGP domain formation is reduced greatly and the spreading rate of the solution is reduced thereby giving rise to in some cases insufficient coverage by the solution and rough film surface.

Thus, application of steam gives a surface-coated and steam-applied face plate wherein the alkyl silicate in the solution for CTE domain formation coated has been hydrolyzed.

The components used in the solution for NGP domain formation and the preparation method of the solution have been described as above.

The method for coating the solution for NGP domain formation on the above surface-coated and steam-applied face plate is not particularly restricted, but spray coating may be employed, dip coating or spin coating. It is preferable that the solution for NGP domain formation be coated so as to cover the coated solution for CTE domain formation as completely as possible. The dip coating or the spin coating forms a film-like NGP domain. The spray coating forms disc-like or ring-like NGP domains overlapping with each other. Thus, there can be obtained an undried multi-layered face plate comprising a face plate, the solution for CTE domain formation coated thereon and the solution for NGP domain formation coated further thereon, wherein the alkyl silicate in the CTE domain formation has been hydrolyzed by the application of steam.

The conditions for heat-drying the undried multi-layered face plate are not restricted particularly but are preferably at 80°-250° C. for 5-120 minutes.

Thus, there can be obtained a cathode-ray tube of the present invention.

The cathode-ray tube and the process for production thereof according to the present invention are hereinafter described specifically by way of Examples.

EXAMPLE 1

In FIG. 1, a cathode-ray tube 1 comprises a face plate 2, a colored transparent electroconductive (CTE) domain 8 provided on the outer surface of the face plate 2, a non-glare and protective (NGP) domain 9 (hereinafter NGP domain) covering the CTE domain 8, fluorescent substances 5 provided on the inner surface of the face plate 2, a deposited aluminum film 6 formed on the fluorescent substances 5, a shadow mask 7, a funnel 3 melt-bonded to the face plate 2 with a fritted glass 4, etc.

The procedure for forming the film-like CTE domain 8 and the film-like NGP domain 9 is described below. First, the outer surface of the face plate 2 was cleaned with an abrasive, for example cerium oxide ($CeO_2$) and an alkaline cleaner (a product of Henkel-Hakusuisha). Then, on the outer surface was uniformly coated a mixed solution obtained by adding an organic dye to a solution consisting of electroconductive substance ($SnO_2+Sb_2O_3$), ethyl silicate, a mixed solvent (ethanol, IPA, other alcohols and ketones), water and an acid catalyst, using a spinner to form a film-like CTE domain 8. In order to produce a 14-inch type cathode-ray tube, the amount of the solution coated was 10 ml; the rotational speed of the spinner revolution was 100 rpm; and the coating time was one minute. Thereafter, on the film-like CTE domain 8 was spray-coated a solution for NGP domain formation having a composition shown in Table 1 to form a film-like NGP domain 9. In the spray coating, a commercially available air spray gun for low viscosity was used (amount of the solution coated: 20 ml, coating time: about 30 seconds). Next, heat drying was effected at 150° C. for 30 minutes to obtain a face plate having a strong film-like CTE domain 8 and a strong NGP domain 9.

The subsequent procedure was the same as usually employed in the art, whereby a cathode-ray tube was completed.

EXAMPLES 2-4

Cathode-ray tube were prepared in the same manner as in Example 1 except that the type of the color dye used was changed as shown in Table 1.

EXAMPLE 5

A cathode-ray tube was prepared in the same manner as in Example 1 except that the formation of CTE domain was made by spray coating.

EXAMPLE 6

A cathode-ray tube was prepared in the same manner as in Example 5 except that the formation of CTE domain and the formation of NGP domain were made successively.

COMPARATIVE EXAMPLE 1

There was prepared a cathode-ray tube of prior art having the same CTE domain as in Example 1 but having no NGP domain as disclosed in the present invention.

The cathode-ray tubes obtained in Examples 1-6 and Comparative Example 1 were subjected to the following tests.

(1) Color tone

Measured using Hitachi spectrophotometer V-3200 manufactured by HITACHI, LIMITED.

(2) Gloss value

Measured in accordance with JIS Z 8741.

(3) Surface resistance

Measured using TR-3 High Resistance Tester manufactured by Tokyo Denshi, Co., Ltd.

(4) Pencil strength

Measured in accordance with JIS K 5401.

(5) Chemical strength

Expressed by a time in which the color of a film faded to ½ while the film is being immersed in boiling water.

Table 1 shows the results of Examples 1-6 and Comparative Example 1, i.e. the composition and coating method of the solution used for CTE domain formation, the composition and coating method of the solution used for NGP domain formation, the heat-drying conditions, and the properties (color tone, gloss value, surface resistance, pencil strength, chemical strength) of the multi-layered face plate obtained.

Table 1 demonstrates that the cathode-ray tubes of Examples 1-6 gave a gloss value of 70-75% which was about 25-30% less than the gloss value of Comparative Example 1, and showed significant improvements in pencil strength and chemical strength. When each of the tubes of Examples 1-6 was assembled into a TV set to examine the picture, the picture was very easy to watch due to the smaller external light reflectivity (the gloss value is decreased by 25-30%) Each of the tubes of Examples 1-6 gave a surface resistance of $10^7$ Ω/□ and, when assembled into a TV set to measure the decaying time of surface potential at the time of switching on or off, showed satisfactory antistatic property.

Figure 2:
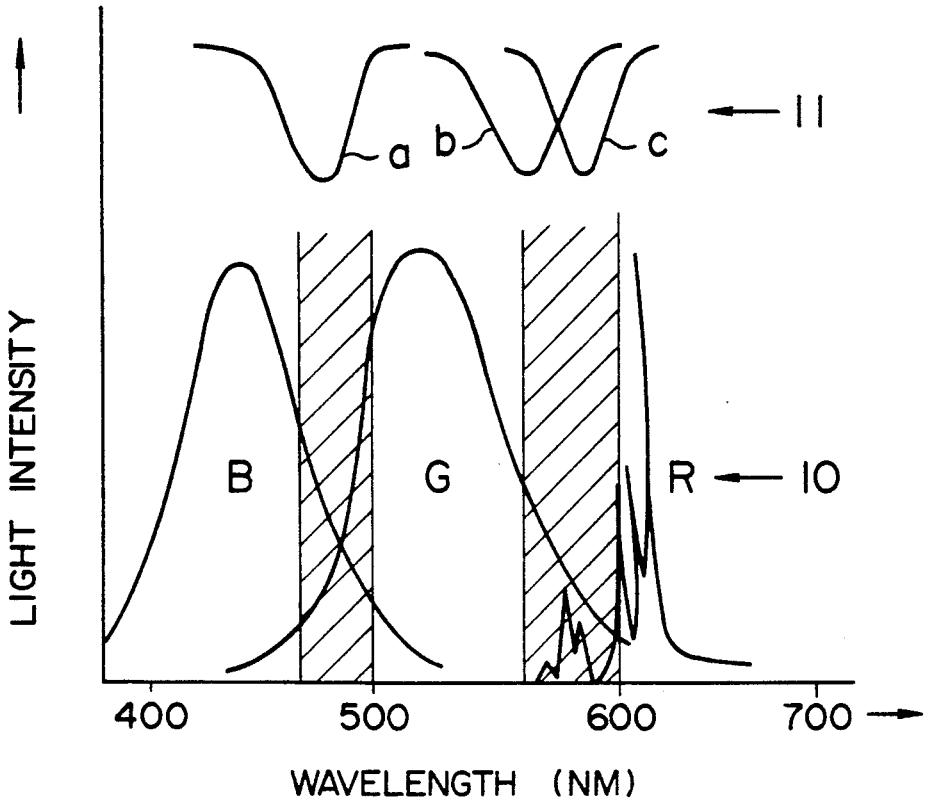
FIG. 2 is a graphical illustration of an emission spectra of fluorescent substances of red, green and blue and the selective absorption characteristics of colored transparent electroconductive domains.

Further when the tubes of Examples 1-6 were assembled into a TV set, unnecessary portions of the light emitted from the red, green and blue fluorescent substances were removed by the selective light absorption of the CTE domain, which gave improved contrast, improved color purities and a distinct picture. Shown in FIG. 2 are the emission spectra 10 of the red R, green G and blue B fluorescent substances and the selective light absorption characteristics 11 of the CTE domain in Examples 1-6 wherein a represents Example 2 and b represents Examples 1, 4, 5, and 6 and Comparative Example 1; and c represents Example 3. It can be well appreciated from FIG. 2 that the intermediate colors (shown in slant lines) of the emission spectra 10 of the fluorescent substances are selectively removed by the selective light absorption characteristics 11 of the CTE domain, giving improved color purities, deepened colors and improved contrast.

In each of Examples 1-6, a single color dye was used, but it is possible to use different dyes in combination depending upon the customer's taste, etc. and in view of the durability of each dye.

TABLE 1

(Composition: % by weight)

| | Example | | | | | | Comparative Example |
|---|---|---|---|---|---|---|---|
| | 1 | 2 | 3 | 4 | 5 | 6 | 1 |
| Colored transparent electro-conductive solution-composition and coating method | | | | | | | |
| Organic dye | | | | | | | |
| Sodium fluorescein | — | 0.2 | — | — | — | — | — |
| Rhodamine | 0.2 | — | — | — | 0.2 | 0.2 | 0.2 |
| Oil blue | — | — | 0.2 | — | — | — | — |
| Oil violet | — | — | — | 0.2 | — | — | — |
| Electroconductive substances ($SnO_2$ + $Sb_2O_3$) | 1 | 1 | 1 | 1 | 1 | 1 | 1 |
| Ethyl silicate | 1.3 | 1.3 | 1.3 | 1.3 | 2.5 | 2.5 | 1.3 |
| Solvent, water and catalyst | 97.5 | 97.5 | 97.5 | 97.5 | 96.5 | 96.5 | 97.5 |
| Coating method | Spin | Spin | Spin | Spin | Spray | Spray | Spin |
| Ethyl silicate | 2.5 | 2.5 | 2.5 | 2.5 | 2.5 | 2.5 | — |
| Silica solution-composition and coating method | | | | | | | |
| Alcohol | 55 | 55 | 55 | 55 | 55 | 55 | — |
| Catalyst and water | 40 | 40 | 40 | 40 | 40 | 40 | — |
| Components of small amounts | 2.5 | 2.5 | 2.5 | 2.5 | 2.5 | 2.5 | — |
| Coating method | Spray | Spray | Spray | Spray | Spray | Spray (immediately after coating of electro-conductive solution) | — |
| Heat-drying conditions | 150° C. × 30 minutes | | | | | | |
| Film properties | | | | | | | |
| Color tone (transmission and absorption) | FIG. 2 b | FIG. 2 a | FIG. 2 c | FIG. 2 b | FIG. 2 b | FIG. 2 b | FIG. 2 b |
| Gloss value (JIS Z 8741) (%) | 75 | 75 | 75 | 75 | 70 | 70 | 100 |
| Surface resistance (Ω/□) | $10^7$ | $10^7$ | $10^7$ | $10^7$ | $10^7$ | $10^7$ | $10^7$ |
| Pencil strength (JIS K 5401) | 6H | 6H | 6H | 6H | 9H | 9H | HB |
| Chemical strength* | 5 hr ≦ | 5 hr ≦ | 5 hr ≦ | 5 hr ≦ | 5 hr ≦ | 5 hr ≦ | 0.5 hr ≧ |

*A time in which the color of a film fades to ½ while the film is being immersed in boiling water.

To form the CTE domain 8 and the NGP domain 9 in a cathode-ray tube of FIG. 1, first the outer surface of the face plate 2 of a completed cathode-ray tube 1 is cleaned with an abrasive (e.g. cerium oxide) and an alkali cleaner manufactured by Henkel-Hakusuisha. Then, on the outer surface was uniformly coated a mixed solution obtained by adding an organic dye to a solution consisting of electroconductive substances ($SnO_2+Sb_2O_3$), ethyl silicate, a mixed solvent of the same composition as in Example 1, water and an acid catalyst, using a spinner to form a CTE domain 8. In this case, the amount of the mixed solution coated was 10 ml, the rotational speed of the spinner was 100 rpm, and the coating time was one minute in order to produce a 14-inch type cathode-ray tube. Thereafter, the resulting cathode-ray tube was inserted into a furnace to preheat the face plate surface to about 50° C.; in this state, steam was introduced into the furnace to expose the face plate surface to steam for about five minutes. Next, on the face plate surface was spray-coated a solution for NGP domain formation having the following composition.

| | |
|---|---|
| Ethyl silicate | 2.5% by weight |
| Ethanol | 55% by weight |
| $HNO_3$ and water | 40% by weight |
| Additives | 2.5% by weight |

The resulting tube was inserted into a furnace to effect heat drying at 160° C. for thirty minutes to complete a cathode-ray tube having a CTE domain 8 of selective light absorbability and an NGP domain (silica mainly composed of silica gel) 9.

The thus obtained tube, having a surface resistance of $1\times10^8$ Ω/□ and a gloss value of 80% as measured by JIS Z 8741, showed no reduction in color dye contributing to selective light absorption due to wiping of panel surface, and gave less color fading by external light (ultraviolet rays in particular) than the prior art tube. Thus, there could be obtained a cathode-ray tube having excellent properties such as high contrast and non-glareness.

EXAMPLE 8

In accordance with the procedure of Example 7, a CTE domain was formed on the face plate outer surface of a cathode-ray tube. The tube was then inserted into a furnace; the face plate was preheated to 50° C. and then exposed to steam and successively spray-coated with the same solution for NGP domain formation as used in Example 7; and lastly the tube was heat-dried at 160° C. for thirty minutes.

The thus obtained multi-layered face plate had the same high quality as in the case of Example 7.

EXAMPLE 9

A cathode-ray tube was subjected to the same face plate surface treatment as in Example 7, after which a solution for CTE domain formation of a type similar to that of Example 7 was spray-coated on the face plate surface. The subsequent procedure was the same as in Example 7, whereby a cathode-ray tube having a CTE domain and an NGP domain was prepared.

In this case also, the multi-layered face plate obtained, having a surface resistance of $5\times10^8$ Ω/□ and a gloss value of 75% as measured by JIS Z 8741, showed no reduction in color dye, and had optical stability.

COMPARATIVE EXAMPLE 2

A CTE domain and an NGP domain were formed in the same manner as in Example 7 except that no exposure to steam was conducted. The time from CTE domain formation to NGP domain formation, including preheating was ten minutes.

In the thus obtained multi-layered face plate, the dye in the CTE domain oozed onto the outer surface of the NGP domain and there occurred partial reduction in dye when the face plate surface was strongly wiped with ethanol. Further, a test showed that the color fading by sunlight or ultraviolet rays was about twice as fast than the samples of Examples 7–9.

COMPARATIVE EXAMPLE 3

Two cathode-ray tubes were prepared in the same manner as in Comparative Example 2 except that the time intervals between the CTE domain formation and the NGP domain formation were two hours and twenty-four hours..

The tube of two hours time interval showed slight improvement in dye reduction but the improvement was insufficient. The tube of twenty-four hours time interval showed no dye reduction but such a time interval is not suitable for practical application.

COMPARATIVE EXAMPLE 4

A cathode-ray tube was prepared in the same manner as in Example 7 except that the contact with steam was changed to room temperature spraying by ultrasonic moistening. The tube showed slight improvement in dye reduction but could not completely prevent dye reduction.

EXAMPLE 10

FIG. 1 is a partially broken sectional view showing the constitution of one embodiment of the cathode-ray tube of the present invention. In FIG. 1, 1 is a cathode-ray tube, and the outer frame of the cathode-ray tube is constituted by a face plate 2, a funnel 3 having a neck portion, and a fritted glass 4 sealing the face plate 2 and the funnel 3 air-tightly. 5 is fluorescent substances, and 6 is a deposited aluminum film formed on the fluorescent substances 5. 7 is a shadow mask, 8 is a CTE domain formed on the outer surface of the face plate 2 in the method described later, and 9 is a NGP domain formed on the CTE domain 8 so as to cover the CTE domain 8. The CTE domain 8 was formed To form the CTE domain 8 of the cathode-ray tube of FIG. 1, first the outer surface of the face plate 2 of a cathode-ray tube 1 was cleaned according to a predetermined procedure; then, the outer surface was spin-coated with a solution for CTE domain formation containing organic dyes and having a composition shown in the upper portion of Table 2; thereafter, heat drying was effected at 150° C. for thirty minutes to form a CTE domain 8. The solution components other than dyes were shown in Table 3. Incidentally, the names of the dyes shown in Table 2 are those described in "Dyes Handbook" (published from Maruzen on Jun. 6, 1959). Each C.I. No. in Table 2 refers to a color index No. described in the handbook.

EXAMPLES 11–12

CTE domains 8 of Examples 11 and 12 were formed in the same manner as in Example 10 except that the solution for CTE domain formation was changed to the respective compositions shown in Tables 2 and 3.

EXAMPLE 13

A CTE domain 8 was formed in the same manner as in Example 10 except that as the solution for CTE domain formation two solutions of compositions shown in Table 2 were used to form a CTE domain of doublelayer structure.

EXAMPLE 14

A CTE domain 8 was formed in the same manner as in Example 10 except that the formation of CTE domain was effected by spray coating.

EXAMPLE 15

A CTE domain 8 was formed in the same manner as in Example 10. Then, a solution having a composition shown in Table 4 was spray-coated on the CTE domain 8 to form an NGP domain 9.

EXAMPLE 16

A cathode-ray tube having the same constitution as the tube of Example 15 was prepared except that the CTE domain was formed by spray coating.

COMPARATIVE EXAMPLE 5

A CTE domain 8 was formed in the same manner as in Example 10 except that the organic dye used in the solution for CTE domain formation was only Acid Rhodamine B.

Each of the above-prepared multi-layered face plates was measured for properties such as color tone, chemical strength and optical strength. The results are shown in the lower portion of Table 2.

Figure 3:
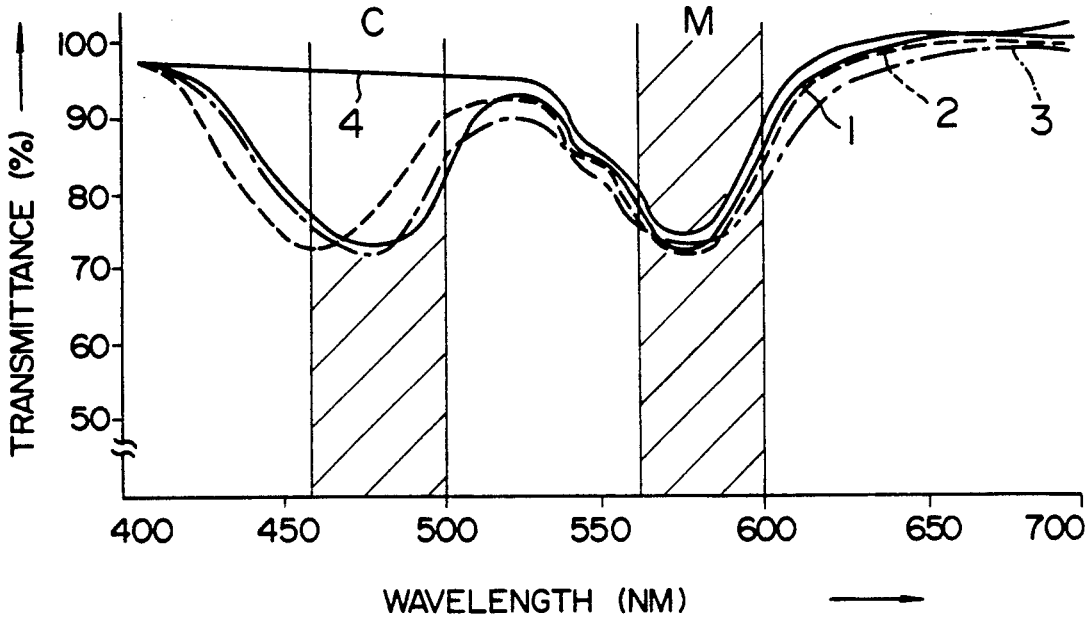
FIG. 3 is a graphical illustration of initial spectral transmittance curves of colored transparent electroconductive domains.
Figure 4:
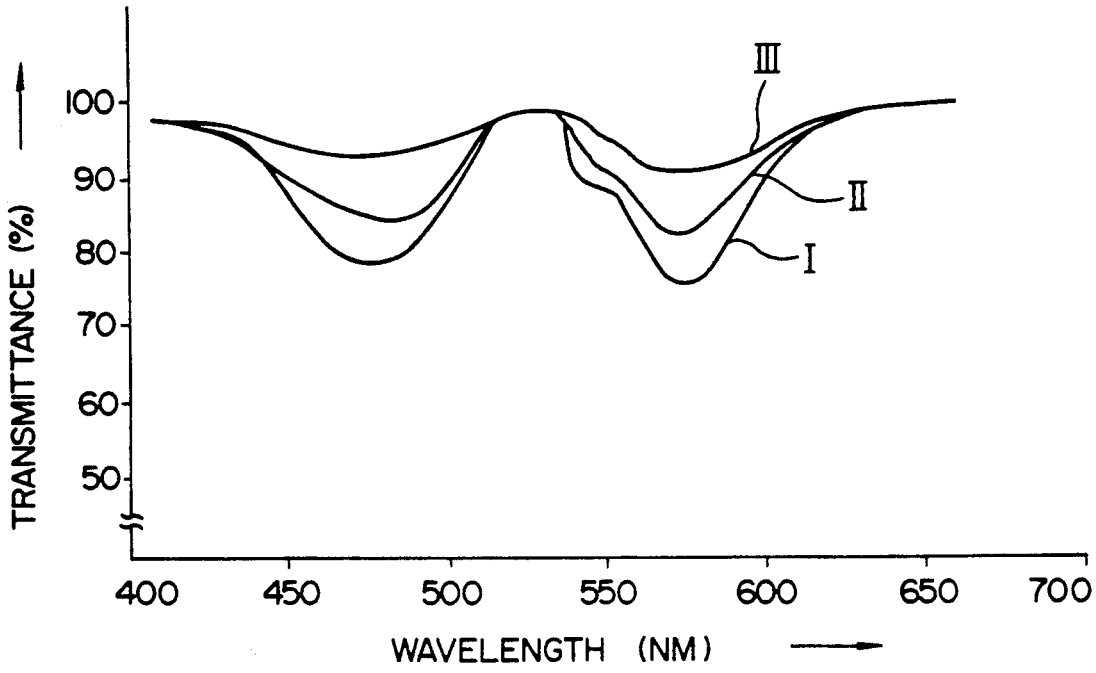
FIG. 4 is a graphical illustration of changes with time of the spectral transmittance curves of colored transparent electroconductive domains.

In Table 2, color tone indicates the distinctness of a picture given by each multi-layered face plate, as a result of disappearance of (a) an unnecessary intermediate color C between the emission spectra B (blue) and G (green) emitted from the fluorescent substances and (b) an unnecessary intermediate color M between the emission spectra G and R (red) (see FIG. 2), and is expressed by the spectral transmittance curve $C_1$, $C_2$ or $C_3$ of FIG. 3 obtained with each multi-layered face plate. In measurement of chemical stability and light resistance, each multi-layered face plate was immersed in boiling water (chemical stability) or exposed to direct sunlight (light resistance) and then measured for deterioration in spectral transmittance by examining hours (chemical stability) or days (light resistance) to a time when each multi-layered face plate showed 20% transmittance deterioration (II in FIG. 4) against the initial transmittance (I in FIG. 4) or showed 50% transmittance deterioration (III in FIG. 4).

TABLE 2

(Composition: % by weight)

| | Example | | | | | | | Comparative Example |
|---|---|---|---|---|---|---|---|---|
| | 10 | 11 | 12 | 13 | 14 | 15 | 16 | 5 |
| Colored transparent electroconductive film-composition and coating method | | | | | | | | |
| Acid dye | | | | | | | | |
| Acid Rhodamine B (C.I. No. R-52) | 0.01 | 0.01 | | 0.01 (second layer) | 0.01 | 0.01 | 0.01 | 0.05 |
| Alizarine Direct Blue AGG (C.I. No. B-40) | 0.05 | 0.05 | 0.05 | 0.05 (first layer) | 0.05 | 0.05 | 0.05 | |
| Acid Light Yellow 2G (C.I. No. Y-17) | | 0.03 | | | | | | |
| Acid Red 3BL (C.I. No. R-254) | | | 0.02 | | | | | |
| Direct dye | | | | | | | | |
| Sirius Supra Orange GGL (C.I. No. 0-39) | 0.03 | | | 0.03 (first layer) | 0.03 | 0.03 | 0.03 | |
| Reactive dye | | | | | | | | |
| React Yellow E-SNA (C.I. No. Y-102) | | | 0.03 | | | | | |
| Solution components other than dyes | Table 3 | | | | | | | |
| Coating method | Spin | Spin | Spin | Spin | Spray | Spin | Spray | Spin |
| Components of overcoating solution (spray coating) | — | — | — | — | — | Table 4 | Table 4 | — |
| Heat-drying conditions | 150° C. × 30 minutes | | | | | | | |
| Film properties | | | | | | | | |
| Color tone | FIG. 3 | FIG. 3 | FIG. 3 | FIG. 3 | FIG. 3 | FIG. 3 | FIG. 3 | FIG. 3 |
| (film transmittance) | 1 | 2 | 3 | 1 | 1 | 1 | 1 | 4 |
| Chemical strength | | | | | | | | |
| Time to FIG. 4 II (hr) | 2 | 2.5 | 3.0 | 2.5 | 1.5 | 10 | 5 | 1 |
| Time to FIG. 4 III (hr) | 5 | 6 | 6.5 | 5.5 | 3.5 | 20 | 10 | 3 |
| Optical strength | | | | | | | | |
| Days to FIG. 4 II | 30 | 25 | 25 | 35 | 20 | 60 | 50 | 5 |
| Days to FIG. 4 III | 90 | 85 | 90 | 100 | 70 | 120 | 100 | 10 |

TABLE 3

| | |
|---|---|
| Electroconductive substances ($SnO_2 + Sb_2O_3$) | 1% by weight |
| Ethyl silicate | 1.3% by weight |
| Solvent, water and catalyst | 97.5% by weight |

TABLE 4

| | |
|---|---|
| Ethyl silicate | 2.5% by weight |
| Alcohols | 55% by weight |
| Catalyst and water | 40% by weight |
| Components of minor amounts | 2.5% by weight |

As to color tone, each of the multi-layered face plates of Examples 10–16 absorbs M and C ranges sufficiently and shows excellent optical properties. In contrast, the multi-layered face plate of Comparative Example 5 shows sufficient absorption for M range but no absorption for C range and, accordingly, gives a low color purity for blue range.

As to chemical stability and light resistance, each of the multi-layered face plates to Examples 10–16 shows high values and those of Examples 15–16 show particularly high values. In contrast, the multi-layered face plate of Comparative Example 5 shows slightly low chemical stability and fairly low light resistance. This indicates that the combined use of two or more organic dyes gives a synergistic effect on chemical stability and light resistance and that the presence of NGP domain contributes greatly to the improvement of chemical stability and light resistance.

As described above, the process for producing a cathode-ray tube according to the present invention can solve the problems of the prior art and can easily provide a cathode-ray tube which has wide and stable optical properties, high image contrast and non-glare property and which is free from panel electrification due to static induction.

Further, in an embodiment of the present cathode-ray tube, the unnecessary intermediate colors of the spectra emitted from the fluorescent substances are selectively and simultaneously absorbed, whereby improved image contrast, improved color purities and a more distinct image are provided.

Further, according to the present process, the time required from formation of colored transparent electroconductive film to formation of non-glare and protective film, which has been at least 120 minutes in the prior art, can be shortened to five minutes or less, i.e. about 1/20 or less. This is a big advantage is in mass production of cathode-ray tube.

What is claimed is:

1. A cathode-ray tube having a layer on at least one portion of a faceplate outer surface, the layer comprising:

at least one colored transparent electroconductive domain consisting of at least one organic dye, at least one electroconductive metal oxide selected from the group consisting of tin oxide, indium oxide, and antimony oxide, and silica mainly composed of silica gel, and at least one non-glare and protective domain consisting of silica mainly composed of silica gel.

2. A cathode-ray tube according to claim 1, wherein the layer comprising the color transparent electroconductive domain and the non-glare and protective domain consists of at least one layer of the colored transparent electroconductive domain and one layer of the non-glare and protective domain, and the layer of the non-glare and protective domain is formed on the at least one layer of the color transparent electroconductive domain.

3. A cathode-ray tube according to claim 1, wherein the colored transparent electroconductive domain is a continual layer and the non-glare and protective domain is formed thereon in the form of discs or rings overlapping with each other.

4. A cathode-ray tube according to claim 2, wherein the at least one layer of the colored transparent electroconductive domain is in the form of discs or rings overlapping with each other and the one layer of the non-glare and protective domain formed thereon is a continual layer.

5. A cathode-ray tube according to claim 1, wherein the colored transparent electroconductive domain is in the form of discs or rings overlapping with each other and the non-glare and protective domain formed thereon is in the form of discs or rings overlapping with each other.

6. A cathode-ray tube according to claim 1, wherein the colored transparent electroconductive domain absorbs a light of a wavelength in a vicinity of 560–600 nm and a light of a wavelength in a vicinity of 480–500 nm selectively.

7. A cathode-ray tube according to claim 1, wherein the silica mainly composed of silica gel has a film form and/or consists of fine particles.

8. A cathode-ray tube according to claim 1, wherein the at least one electroconductive metal oxide has particle diameters of 100 nm or less.

9. A cathode-ray tube having a plurality of phosphors emitting a different primary color coated on an inner surface of a faceplate and a layer on at least one portion of an outer surface of said face plate, the layer comprising:

at least one colored transparent electroconductive domain consisting of at least one organic dye having major absorption in a region between dominant light emission wavelengths of two of said phosphors adjacent to each other in terms of said dominant light emission wavelengths, at least one electroconductive metal oxide selected from a group consisting of tin oxide, indium oxide and antimony oxide, and silica mainly composed of silica gel, and at least one non-glare and protective domain consisting of silica mainly composed of silica gel.

* * * * *